US007910193B2

(12) United States Patent
Ma

(10) Patent No.: US 7,910,193 B2
(45) Date of Patent: Mar. 22, 2011

(54) THREE-DIMENSIONAL AUXETIC STRUCTURES AND APPLICATIONS THEREOF

(75) Inventor: Zheng-Dong Ma, Ann Arbor, MI (US)

(73) Assignee: MKP Structural Design Associates, Inc., Dexter, MI (US)

( * ) Notice: Subject to any disclaimer, the term of this patent is extended or adjusted under 35 U.S.C. 154(b) by 237 days.

(21) Appl. No.: 12/267,867

(22) Filed: Nov. 10, 2008

(65) Prior Publication Data

US 2010/0119792 A1 May 13, 2010

(51) Int. Cl.
*B32B 3/24* (2006.01)

(52) U.S. Cl. ..... 428/76; 428/218; 442/328; 442/335; 442/336; 442/337; 5/690

(58) Field of Classification Search ..... 428/76, 428/218; 5/690; 442/328, 335, 336, 337
See application file for complete search history.

(56) References Cited

U.S. PATENT DOCUMENTS 4,668,557 A 5/1987 Lakes
7,160,621 B2 1/2007 Chaudhari et al.

*Primary Examiner* — Alexander Thomas
(74) *Attorney, Agent, or Firm* — Gifford, Krass, Sprinkle, Anderson & Citkowski, P.C.

(57) ABSTRACT

Negative Poisson's ratio (NPR) or auxetic structures, including three-dimensional auxetic structures, are disclosed and applied to various applications. One such structure comprises a pyramid-shaped unit cell having four base points A, B, C, and D defining the corners of a square lying in a horizontal plane. Four stuffers of equal length or different lengths extend from a respective one of the base points to a point E spaced apart from the plane. Four tendons of equal length or different lengths, but less than that of the stuffers, extend from a respective one of the base points to a point F between point E and the plane. In three-dimensional configurations, a plurality of unit cells are arranged as tiles in the same horizontal plane with the base points of each cell connected to the base points of adjoining cells, thereby forming a horizontal layer. A plurality of horizontal layers are then stacked with each point E of cells in one horizontal layer being connected to a respective one of the points F of cells in an adjacent layer. Particularly for typical applications, the structure may further including a pair of parallel plates made sandwiching a plurality of horizontal layers of unit cells.

22 Claims, 8 Drawing Sheets

THREE-DIMENSIONAL AUXETIC STRUCTURES AND APPLICATIONS THEREOF

FIELD OF THE INVENTION

This invention relates generally to negative Poisson's ratio (NPR) or auxetic structures and, in particular, to three-dimensional auxetic structures and applications thereof.

BACKGROUND OF THE INVENTION

Poisson's ratio (ν), named after Simeon Poisson, is the ratio of the relative contraction strain, or transverse strain (normal to the applied load), divided by the relative extension strain, or axial strain (in the direction of the applied load). Some materials, called auxetic materials, have a negative Poisson's ratio (NPR). If such materials are stretched (or compressed) in one direction, they become thicker (or thinner) in perpendicular directions.

The vast majority of auxetic structures are polymer foams. U.S. Pat. No. 4,668,557, for example, discloses an open cell foam structure that has a negative Poisson's ratio. The structure can be created by triaxially compressing a conventional open-cell foam material and heating the compressed structure beyond the softening point to produce a permanent deformation in the structure of the material. The structure thus produced has cells whose ribs protrude into the cell resulting in unique properties for materials of this type.

Auxetic and NPR structures have been used in a variety of applications. According to U.S. Pat. No. 7,160,621, an automotive energy absorber comprises a plurality of auxetic structures wherein the auxetic structures are of size greater than about 1 mm. The article also comprises at least one cell boundary that is structurally coupled to the auxetic structures. The cell boundary is configured to resist a deformation of the auxetic structures.

NPR structures can react differently under applied loads. FIG. 1 illustrates a reactive shrinking mechanism, obtained through a topology optimization process. The unique property of this structure is that it will shrink in two directions if compressed in one direction. FIG. 1 illustrates that when the structure is under a compressive load on the top of the structure, more material is gathered together under the load so that the structure becomes stiffer and stronger in the local area to resist against the load.

SUMMARY OF THE INVENTION

This invention is directed to negative Poisson's ratio (NPR) or auxetic structures and, in particular, to three-dimensional auxetic structures and applications thereof. One such structure comprises a pyramid-shaped unit cell having four base points A, B, C, and D defining the corners of a square lying in a horizontal plane. Four stuffers of equal length extend from a respective one of the base points to a point E spaced apart from the plane. Four tendons of equal length, but less than that of the stuffers, extend from a respective one of the base points to a point F between point E and the plane.

The stuffers and tendons have a rectangular, round, or other cross sections. For example, the stuffers may have a rectangular cross section with each side being less than 10 millimeters, and the tendons may have a rectangular cross section with each side being less than 10 millimeters. As one specific but non-limiting example, the stuffers may be 5 mm×3 mm, and the tendons may be 5 mm×2 mm.

According to one preferred embodiment, the angle formed between opposing stuffers from points A and C or B and D is on the order of 60 degrees, and the angle formed between opposing tendons from points A and C or B and D is on the order of 130 degrees, though other angles may be used.

In three-dimensional configurations, a plurality of unit cells are arranged as tiles in the same horizontal plane with the base points of each cell connected to the base points of adjoining cells, thereby forming a horizontal layer. A plurality of horizontal layers are stacked with each point E of cells in one horizontal layer being connected to a respective one of the points F of cells in an adjacent layer. In certain applications, the structure may further including a pair of parallel plates made sandwiching a plurality of horizontal layers of unit cells. The plates may be made of any suitable rigid materials, including metals, ceramics and plastics. The structure may further include an enclosure housing a plurality of horizontal layers of unit cells, thereby forming a mattress.

The stuffers and the tendons may be of equal or unequal length, and may have equal or unequal cross sections. The tiles may be arranged in parallel or diagonal patterns, and different layers may include unit cells with different dimensions or compositions, resulting in a functionally-graded design.

The stuffers may be made of metals, ceramics, plastics, or other compressive materials, and the tendons may be made of metals, plastics, fibers, fiber ropes, or other tensile materials. In one preferred embodiment, the stuffers and tendons are made of steel, with the cross-sectional area of the tendons being less than the cross-sectional area of the stuffers. pair of parallel plates sandwiching a plurality of horizontal layers of unit cells.

A pair of parallel plates or panels may be used to sandwich a plurality of horizontal layers of unit cells. Such plates or panels may be composed of metals such as aluminum, fabrics, fiber-reinforced polymer composites or other materials or layers. For example, the structure may further include an enclosure housing a plurality of horizontal layers of unit cells, thereby forming a mattress.

The geometry, dimensions or composition of the tendons or stuffers may be varied to achieve different effective material properties along different directions, to achieve a different effective Young's modulus along different directions, or to achieve different effective Poisson's ratios along different directions. The structures may achieve different material densities in different layers.

BRIEF DESCRIPTION OF TIE DRAWINGS

DETAILED DESCRIPTION OF THE INVENTION

Figure 1:
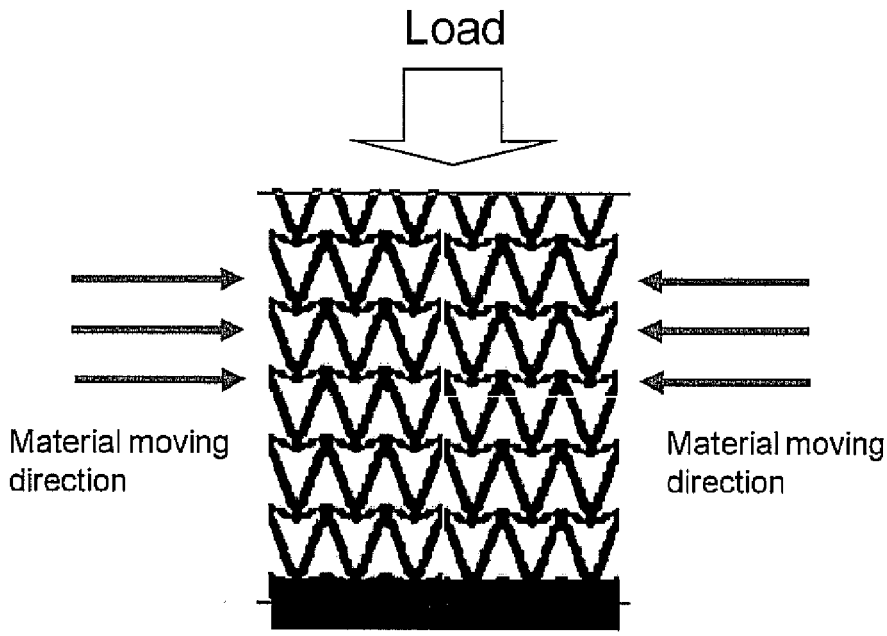
FIG. 1 illustrates a reactive shrinking mechanism, obtained through a topology optimization process.
Figure 2:
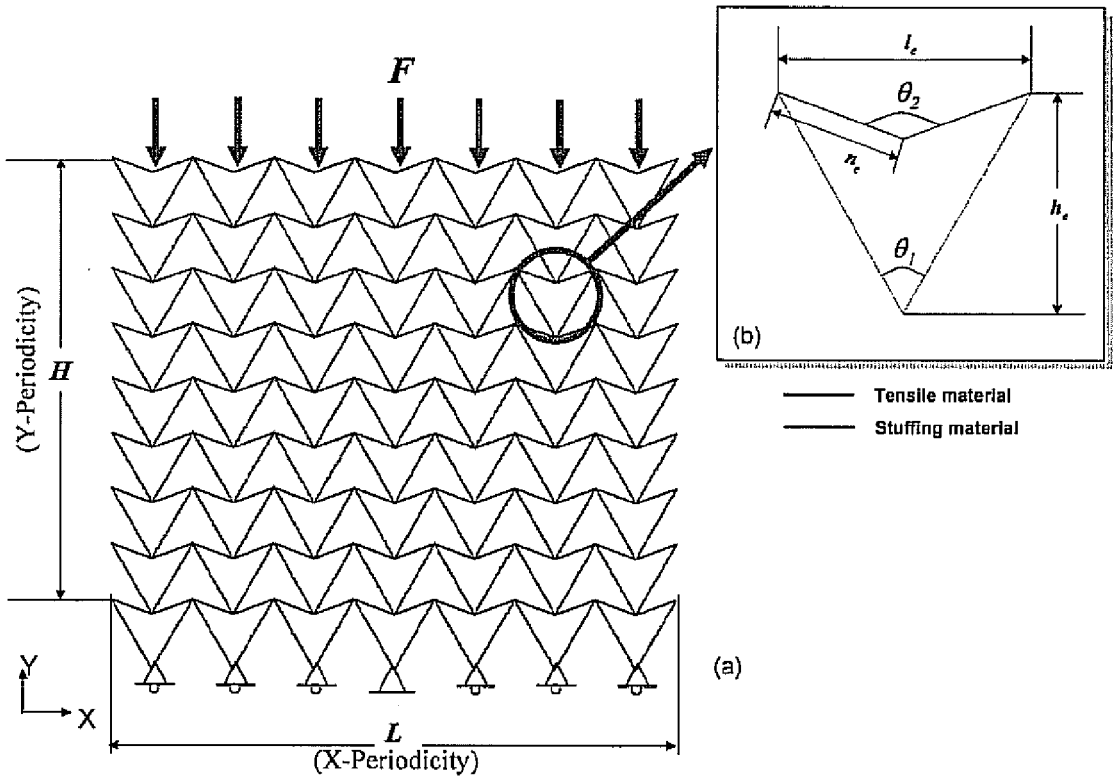
FIG. 2 illustrates a particular negative Poisson ratio (NPR) structure.

Having discussed basic two-dimensional shrinking and shearing structures in FIG. 1, the reader's attention is now directed to FIG. 2 which illustrates a negative Poisson's ratio (NPR) structure having the unique property that it will shrink along all directions when compressed in one direction. A nonlinear finite element method has been developed with a multi-step linearized analysis method to predict nonlinear behavior of this material. Effective material properties, such as Young's modulus, Poisson's ratio, material density, and load-bearing efficiency can then be calculated with consideration of the geometric nonlinear effect for any large load amplitudes.

Figure 3B:
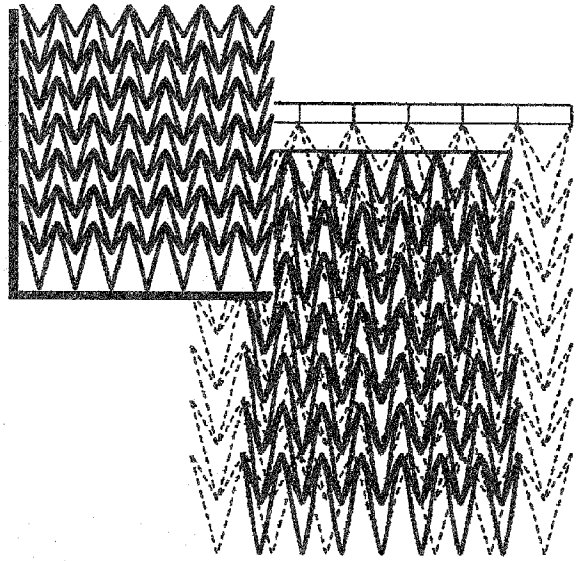
FIG. 3B illustrates the material of FIG. 2 with $\theta_1$=30° and $\theta_2$=60°.
Figure 3A:
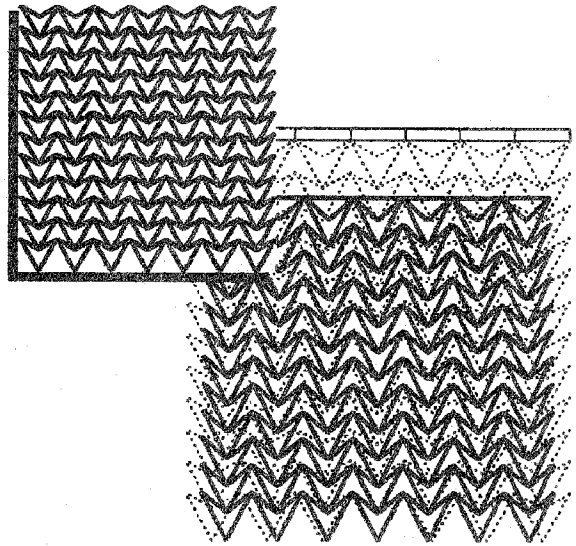
FIG. 3A illustrates the material of FIG. 2 with $\theta_1$=60° and $\theta_2$=120°.

FIG. 3 shows two example designs that were evaluated. FIG. 3A illustrates a material design with $\theta_1=60°$ and $\theta_2=120°$, while FIG. 3B illustrates another design with $\theta_1=30°$ and $\theta_2=60°$. FIG. 3 also illustrates the predicted deformation shapes and effective material properties of the two designs, in which, v denotes the effective Poisson's ratio and E is the effective Young's modulus. In FIGS. 3A and B, dashed lines represent the undeformed shape, and solid lines represent the deformed shape. Comparing FIGS. 3A and B, it is seen that the deformation shapes of the two designs are very different under the same loading condition. The effective Poisson's ratio changed from $\nu=-0.96$ to $\nu=-7.4$ from design #1 to design #2, while the effective Young's modulus changed from E=1.4e3 MPa to E=2.7e3 MPa. This suggests that the second design is better suited to problems that require a large absolute value of NPR and a higher Young's modulus.

Figure 4:
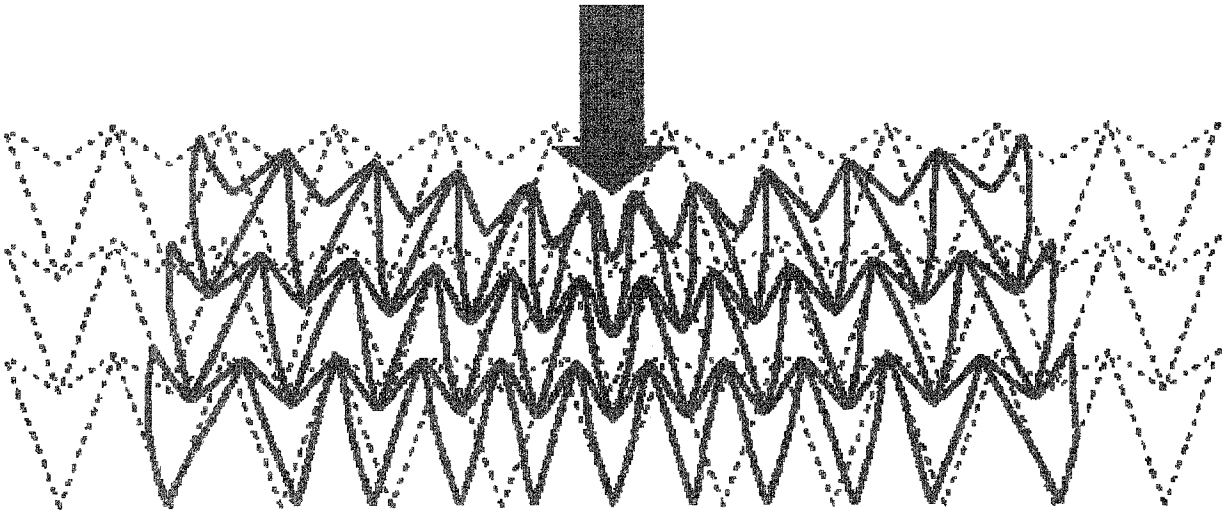
FIG. 4 illustrates how an NPR structure can be used in load-bearing application.

FIG. 4 illustrates how the NPR structure of FIG. 1A can be used in a typical application, wherein localized pressure is applied to an NPR structure. The original structure configuration is shown in dashed lines, and solid lines illustrate the deformed structure obtained from the simulation. As shown in the Figure, the surrounding material is concentrated into the local area due to the negative Poisson's ratio effect as the force is applied. Therefore the material becomes stiffer and stronger in the local area.

Figure 5:
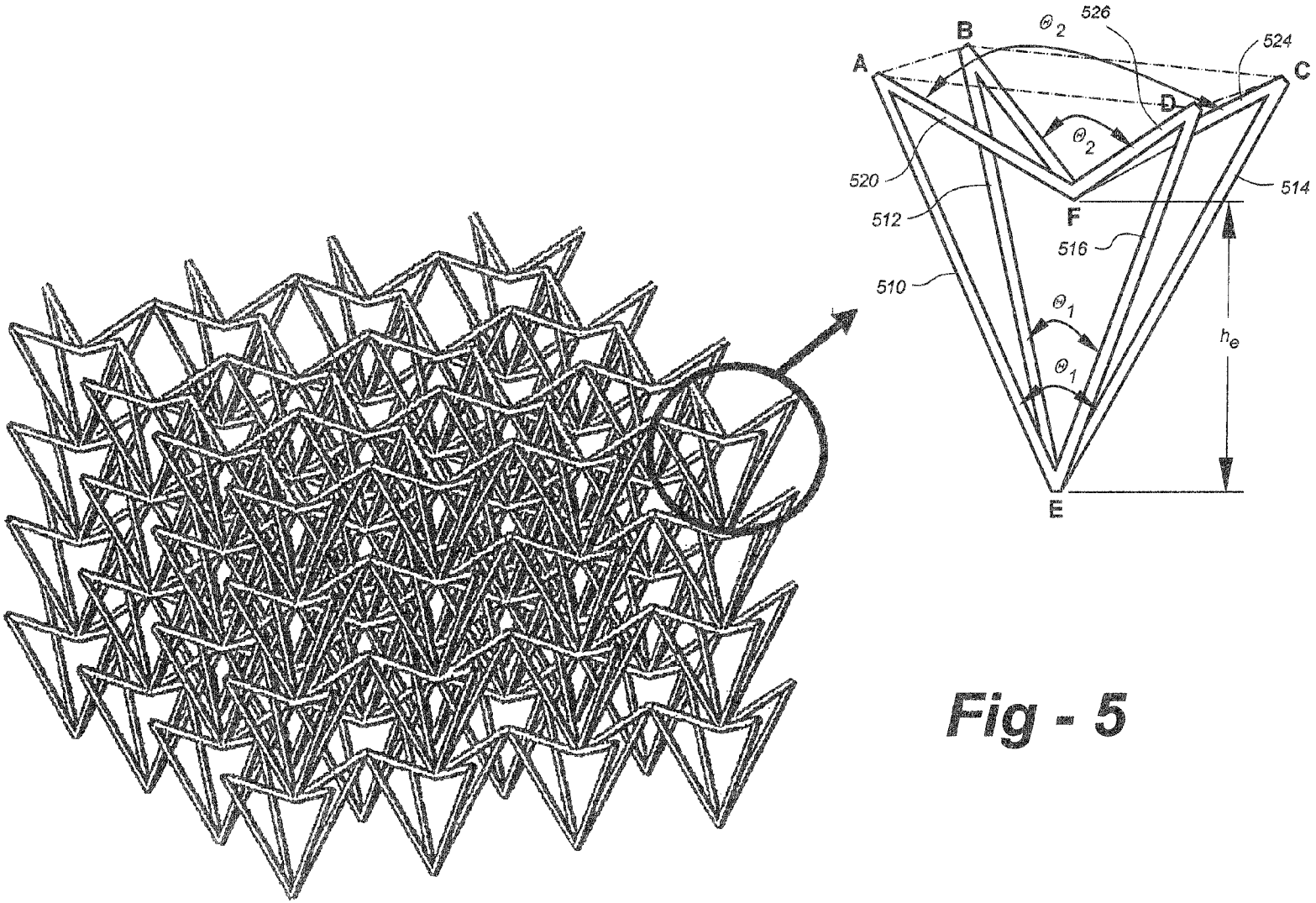
FIG. 5 illustrates a three-dimensional version of the NPR structure.

FIG. 5 shows how the shrinking mechanism can be extended to a three-dimensional auxetic structure. The structure is based upon a pyramid-shaped unit cell having four base points A, B, C, and D defining the corners of a square lying in a horizontal plane 502. Four stuffers 510, 512, 514, 516 of equal length extend from a respective one of the base points to a point E spaced apart from plane 502. Four tendons 520, 522, 524, 526 of equal length, but less than that of the stuffers, extend from a respective one of the base points to a point F between point E and the plane 502. While this and other structures disclosed herein depict points E and F positioned downwardly from the horizontal plane, it will be appreciated that the structure and those in FIGS. 1, 2-4 and 7 may be flipped over and produce the same effect.

The stuffers and tendons may be made of any suitable rigid materials, including metals, ceramics and plastics. In one embodiment, the stuffers and tendons are made of steel, with the cross-sectional area of the tendons being less than the cross-sectional area of the stuffers. For example, the stuffers may have a rectangular cross section with each side being less than 10 millimeters, and the tendons may have a rectangular cross section with each side being less than 10 millimeters. As one specific but non-limiting example, the stuffers may be 5 mm×3 mm, and the tendons may be 5 mm×2 mm.

According to one preferred embodiment, the angle formed between opposing stuffers from points A and C or B and D is on the order of 60 degrees, and the angle formed between opposing tendons from points A and C or B and D is on the order of 130 degrees, though other angles may be used as described in further detail below In the three-dimensional embodiment, a plurality of unit cells are arranged as tiles in the same horizontal plane with the base points of each cell connected to the base points of adjoining cells, thereby forming a horizontal layer. A plurality of horizontal layers are stacked with each point E of cells in one horizontal layer being connected to a respective one of the points F of cells in an adjacent layer. In some applications, the structure may further including a pair of parallel plates made sandwiching a plurality of horizontal layers of unit cells. The plates may be made of any suitable rigid materials, including metals, ceramics and plastics.

The example of FIG. 4 shows that an NPR structure can improve its performance by redistributing its materials and morphine its shape in a load-bearing event without utilizing extra energy supply. Using the new design possibilities for three-dimensional designs, more advanced load-bearing structures can be designed and tailored to a wide range of applications. For example, the configuration of FIG. 5 may be used in applications such as the construction of mattresses. In such applications, the upper and lower "plates" would be replaced with flexible padding or fabric. As with other embodiments, the space around the unit cells may be filled with a material such as foam.

Figure 6A:
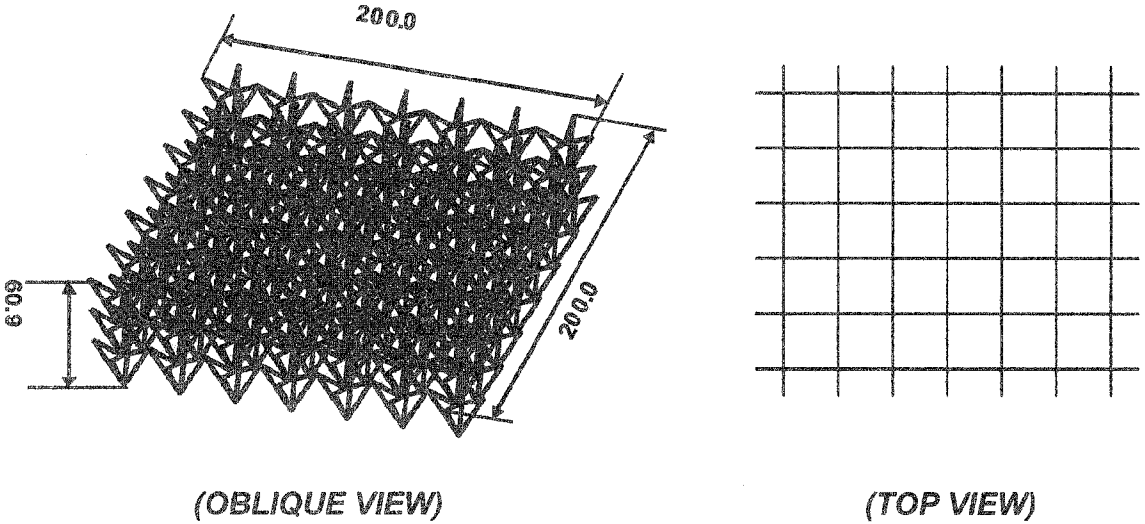
FIG. 6A is an example parallel-arranged 3D NPR structure.
Figure 6B:
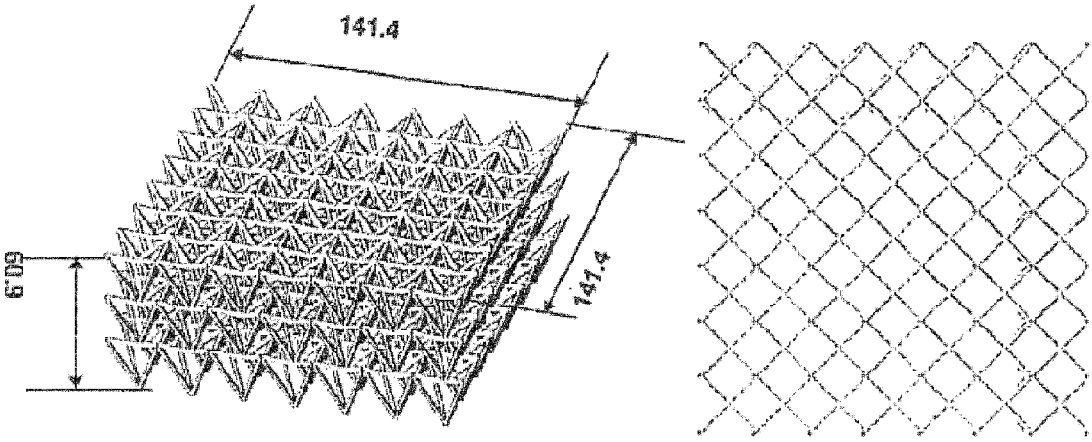
FIG. 6B is an example diagonally-arranged 3D NPR structure.

According to the invention, different three-dimensional NPR structures can be formed with the same unit cell but different arrangements of the unit cells. FIG. 6A is an example of a parallel-arranged 3D NPR structure, whereas FIG. 6B is an example of a diagonally-arranged 3D NPR structure. Arranging 147 unit cells (7 by 7 in each layer) in a parallel pattern, as one example of many, results in a NPR structure with a dimension of 200 mm×200 mm×60.9 mm. Arranging the same number of unit cells in a diagonal pattern results in a different NPR structure with a dimension of 141.4 mm×141.4 mm×60.9 mm and different material properties. The following table compares material properties of the above two designs for this typical example:

| NPR Structure | Young's Modulus (MPa) | Poisson Ratio | Material Density (%) | Material Efficiency |
|---|---|---|---|---|
| Parallel pattern | 2.1e2 | −0.76 | 14.4 | 14.6 |
| Diagonal pattern | 6.5e2 | −0.66 | 21.9 | 29.7 |

Figure 7B:
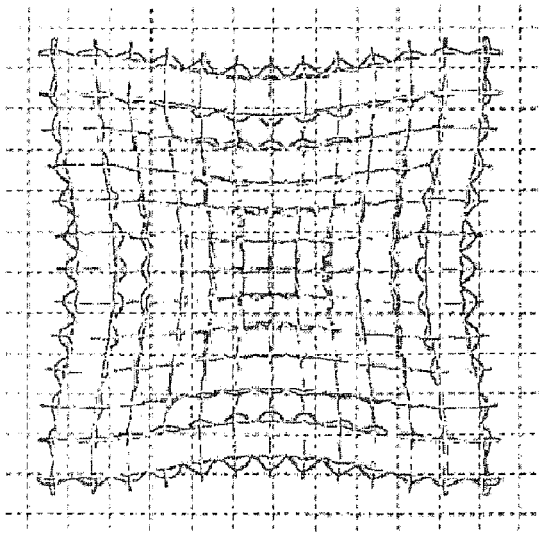
FIGS. 7A and 7B illustrate a three-dimensional NPR structure having two negative (effective) Poisson's ratios in a horizontal plane.
Figure 7A:
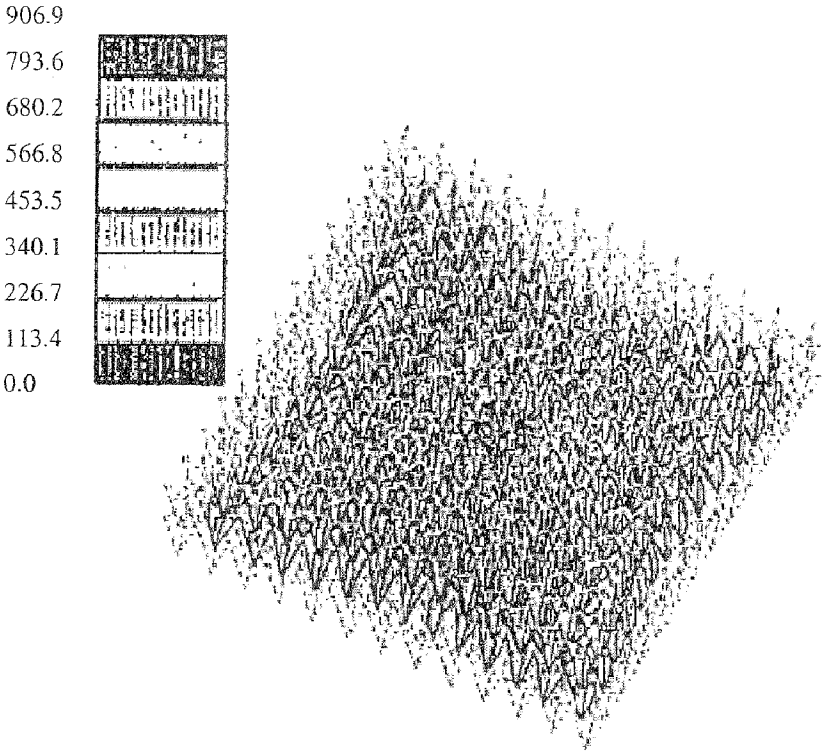
Figure 8A:
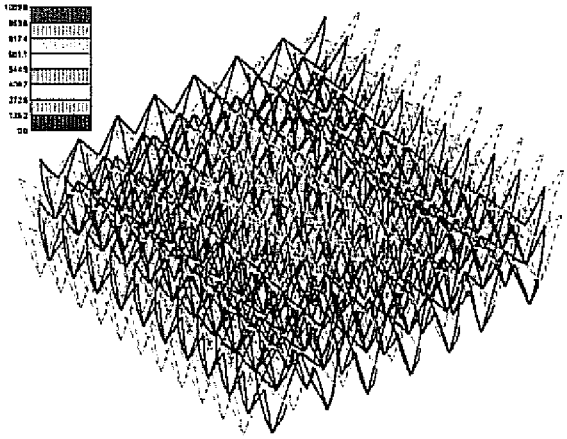
FIGS. 8A and 8B illustrate a three-dimensional NPR structure having one negative (effective) Poisson's ratio and one positive (effective) Poisson's ratio.
Figure 8B:
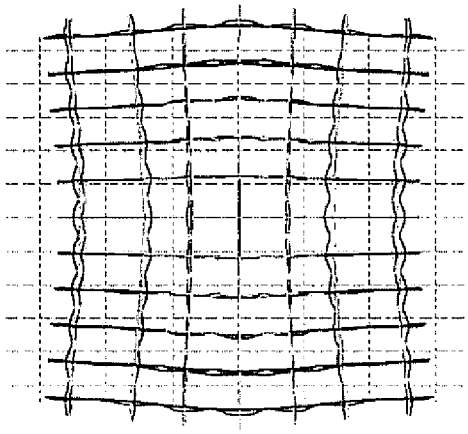

By adjusting geometry, the dimensions (i.e., cross-section and/or length), and/or the composition of the tendons and/or stuffers, three-dimensional NPR structures may be designed with different Poisson's ratios in different directions. Such structures may have two negative Poisson's ratios; one negative Poisson's ratio and one positive Poisson's ratio; or two positive Poisson's ratios. FIGS. 7A and 7B illustrate a three-dimensional NPR structure that has two negative (effective) Poisson's ratios (−2.5 in the example) in the horizontal orientation. FIGS. 8A and 8B illustrate the three-dimensional NPR structure that has one negative (effective) Poisson's ratio (−8.3 in the example) and one positive (effective) Poisson's ratio (1.8 in the example) in the horizontal plan.

Figure 9A:
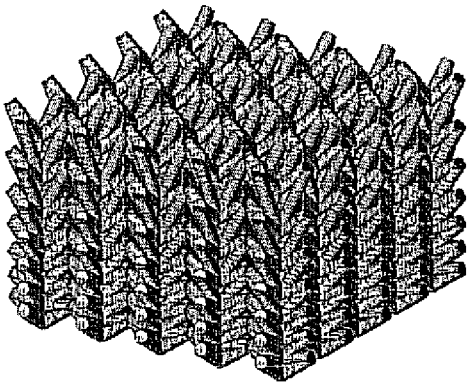
FIGS. 9A and 9B illustrate a three-dimensional NPR structure having a functionally-graded arrangement in the vertical direction, in which each layer of the structure a different effective Young's modulus and Poisson's ratio.
Figure 9B:
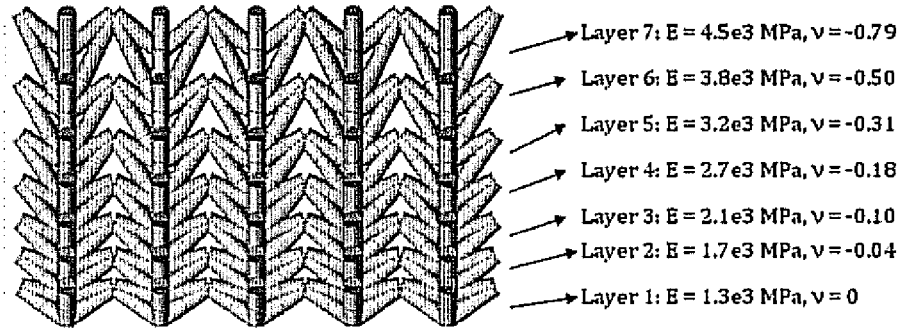

Three-dimensional structures according to the invention may also exhibit a functionally-graded arrangement, in which each layer of the NPR structure has a different effective Young's modulus and Poisson's ratio. FIGS. 9A and 9B show such a structure. This embodiment of the invention may be applied to various applications, including self-locking fastener mechanisms.

I claim:

1. An auxetic structure, comprising:

a pyramid-shaped unit cell having four base points A, B, C, D defining the corners of a square lying in a horizontal plane;

four stuffers, each extending from a respective one of the base points to a point E spaced apart from the plane;

four tendons, each with a length less than that of the corresponding stuffers, each tendon extending from a respective one of the base points to a point F between point E and the plane; and wherein:

a plurality of unit cells are arranged as tiles in the same horizontal plane with the base points of each cell connected to the base points of adjoining cells, thereby forming a horizontal layer, and a plurality of horizontal layers, the layers being stacked such that each point E of cells in one horizontal layer are connected to a respective one of the points F of cells in an adjacent layer.

2. The auxetic structure of claim 1, wherein the angles formed between opposing stuffers from points A and C or B and D can be varied to achieve different effective material properties for different requirements.

3. The auxetic structure of claim 1, wherein the angles formed between opposing tendons from points A and C or B and D are larger than the angles formed between the corresponding opposing stuffers from points A and C or B and D.

4. The auxetic structure of claim 1, wherein the stuffers are of equal or unequal length.

5. The auxetic structure of claim 1, wherein the tendons are of equal or unequal length.

6. The auxetic structure of claim 1, wherein the stuffers are of equal or unequal cross section.

7. The auxetic structure of claim 1, wherein the tendons are of equal or unequal cross section.

8. The auxetic structure of claim 1, wherein the tiles are arranged in parallel or diagonal patterns.

9. The auxetic structure of claim 1, wherein the horizontal layers include unit cells with different dimensions, resulting in a functionally-graded design.

10. The auxetic structure of claim 1, wherein the horizontal layers include unit cells with different material compositions, resulting in a functionally-graded design.

11. The auxetic structure of claim 1, wherein the unit cells are based upon different design variables such that different material properties are achieved along different directions.

12. The auxetic structure of claim 1, wherein the stuffers are made of metals, ceramics, plastics, or other compressive materials.

13. The auxetic structure of claim 1, wherein the tendons are made of metals, plastics, fibers, fiber ropes, or other tensile materials.

14. The auxetic structure of claim 1, wherein the stuffers and tendons have a rectangular, round, or other cross section.

15. The auxetic structure of claim 1, further including a pair of parallel plates sandwiching a plurality of horizontal layers of unit cells.

16. The auxetic structure of claim 1, further including a pair of parallel metal plates sandwiching a plurality of horizontal layers of unit cells.

17. The auxetic structure of claim 1, further including a pair of parallel fiber-reinforced polymer composite plates sandwiching a plurality of horizontal layers of unit cells.

18. The auxetic structure of claim 1, further including an enclosure housing a plurality of horizontal layers of unit cells, thereby forming a mattress.

19. The auxetic structure of claim 1, wherein the geometry, dimensions or composition of the tendons or stuffers are varied to achieve different effective material properties along different directions.

20. The auxetic structure of claim 1, wherein the geometry, dimensions or composition of the tendons or stuffers are varied to achieve a different effective Young's modulus along different directions.

21. The auxetic structure of claim 1, wherein the geometry, dimensions or composition of the tendons or stuffers are varied to achieve different effective Poisson's ratios along different directions.

22. The auxetic structure of claim 1, including different material density in different layers.

* * * * *